US006076828A

United States Patent [19]

McGill

[11] Patent Number: 6,076,828

[45] Date of Patent: Jun. 20, 2000

[54] EDUCATIONAL LANGUAGE SKILLS GAME

[76] Inventor: Nancy E. McGill, 2300 Lane Ave., Anderson, S.C. 29621

[21] Appl. No.: 09/356,878

[22] Filed: Jul. 19, 1999

Related U.S. Application Data

[60] Provisional application No. 60/099,759, Sep. 10, 1998, abandoned.

[51] Int. Cl.[7] ..... A63F 1/00; A63F 9/20

[52] U.S. Cl. ..... 273/292; 273/299; 273/301; 273/304; 273/302; 283/46; 283/45; 434/256; 434/403

[58] Field of Search ..... 273/292, 299, 273/301, 304, 302; 283/46, 45; 434/256, 403

[56] References Cited

U.S. PATENT DOCUMENTS

| | | | |
|---|---|---|---|
| 1,456,834 | 5/1923 | Sheffield . | |
| 1,477,322 | 12/1923 | Degheri . | |
| 2,520,649 | 8/1950 | Northrop . | |
| 3,191,938 | 6/1965 | Smith . | |
| 3,197,891 | 8/1965 | Pierce . | |
| 3,235,976 | 2/1966 | Elliot et al. . | |
| 3,270,430 | 9/1966 | Hurst . | |
| 3,333,351 | 8/1967 | Wiliams . | |
| 3,389,480 | 6/1968 | Holland . | |
| 3,482,333 | 12/1969 | Trager, Jr. | 273/299 |
| 3,618,231 | 11/1971 | Nason | 273/299 |
| 4,171,816 | 10/1979 | Hunt . | |
| 4,234,189 | 11/1980 | Chunn | 273/302 |
| 4,671,516 | 6/1987 | Lizzola et al. | 273/299 |
| 4,907,971 | 3/1990 | Tucker . | |
| 5,487,670 | 1/1996 | Leonhardt . | |

FOREIGN PATENT DOCUMENTS

| | | |
|---|---|---|
| 2313725 | 12/1976 | France . |
| 141053 | 3/1921 | United Kingdom . |
| 1094754 | 12/1967 | United Kingdom . |
| 1127038 | 9/1968 | United Kingdom . |
| 1261901 | 1/1972 | United Kingdom . |
| 1454525 | 11/1976 | United Kingdom . |

*Primary Examiner*—Jessica J. Harrison
*Assistant Examiner*—Dolores Collins
*Attorney, Agent, or Firm*—Richard C. Litman

[57] ABSTRACT

An educational card game is disclosed which consists of a deck of playing cards. One face of each card is inscribed with a word which represents one or more of the eight forms of speech in the English language. The game is designed to enhance the participant's knowledge of the eight forms of speech and recognition that many words can be used to represent more than one of the eight forms of speech.

12 Claims, 3 Drawing Sheets

EDUCATIONAL LANGUAGE SKILLS GAME

CROSS-REFERENCE TO RELATED APPLICATION

This application claims the benefit of U.S. Provisional Patent Application Ser. No. 60/099,759, filed Sep. 10, 1998 now abandoned.

BACKGROUND OF THE INVENTION

1. Field of the Invention

The present invention relates to educational games. More specifically, the present invention is a card game that teaches the players to recognize and use the eight principal forms of speech, namely, nouns , pronouns, verbs, adjectives, adverbs, prepositions, conjunctions, and interjections.

2. Description of Related Art

In the past decade the failure of secondary school students to master even rudimentary language skills has reached alarming proportions. Students are having difficulty learning the eight forms of speech and recognizing that many words can be used as more than one of the eight forms of speech.

There are many patents in the prior art that disclose card games designed to teach language skills. U.S. Pat. No. 3,389,480 (Holland), U.S. Pat. No. 3,482,333 (Trager,Jr.), U.S. Pat. No. 3,618,231 (Nason), U.S. Pat. No. 4,234,189 (Chunn), U.S. Pat. No. 4,671,516 (Lizzola et al.); British Patents 141,053, 1,094,754, 1,127,038, and 1,261,901 all disclose the utilization of cards to teach language skills. However, none of the above listed patents is concerned with the concept of teaching that a particular word may be any one of several forms of speech depending on its usage in a sentence or expression.

U.S. Pat. No. 3,191,938 (Smith), U.S. Pat. No. 3,197,891 (Pierce), U.S. Pat. No. 4,171,816 (Hunt), U.S. Pat. No. 4,907,971 (Tucker); British Patent 1,454,525 and French Patent 2,313,725 show board games for teaching language skills. It is noted that the instant patents do not employ the use of cards or stress the use of a particular word to represent different forms of speech.

U.S. Pat. No. 1,477,332 (Degheri), U.S. Pat. No. 2,520,649 (Northrop), U.S. Pat. No. 3,235,976 (Elliot et al.), U.S. Pat. No. 3,333,351 (Williams), and U.S. Pat. No. 5,487,670 (Leonhardt) show interacting geometrical shapes designed to teach sentence structure.

U.S. Pat. No. 1,456,834 (Sheffield) and U.S. Pat. No. 3,270,430 (Hurst) show the art of visual highlighting as a means to display and teach the parts of speech.

None of the above inventions and patents, taken either singly or in combination, is seen to disclose the use of a card game to teach the eight principal forms of speech and recognition of interchangeable word usage, as described and claimed in the instant invention.

SUMMARY OF THE INVENTION

The present invention is a game which employs a deck comprising three hundred sixty (360) playing cards, each card having a word inscribed on a central portion of one face. In one embodiment of the invention, the inscribed word has all possible forms of speech which it may represent (e.g., noun, adjective, verb) listed in proximity to the word. In a second embodiment of the present invention, only the inscribed word appears on the face of the cards. The first embodiment is designed to be played by participants from age 7 to adult whereas the second embodiment is designed to be more mentally rigorous and is for participants from age 15 to adult. The game may be played by as many as ten players, but is optimized when played by two, three, or four players.

Accordingly, it is a principal object of the present invention to provide a novel card game which includes rules designed to create fun while improving a player's language skills.

It is another object of the present invention to provide a novel card game whose rules are designed to teach a player the eight forms of speech.

It is a further object of the invention to provide a novel card game whose rules are designed to teach a player that a word can often be used to represent any one of several forms of speech.

Still another object of the present invention is to provide a novel card game whose rules are designed to improve a player's power of concentration and strategy skills.

It is an object of the present invention to provide improved elements and arrangements thereof in a card game for the purposes described which are inexpensive, and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
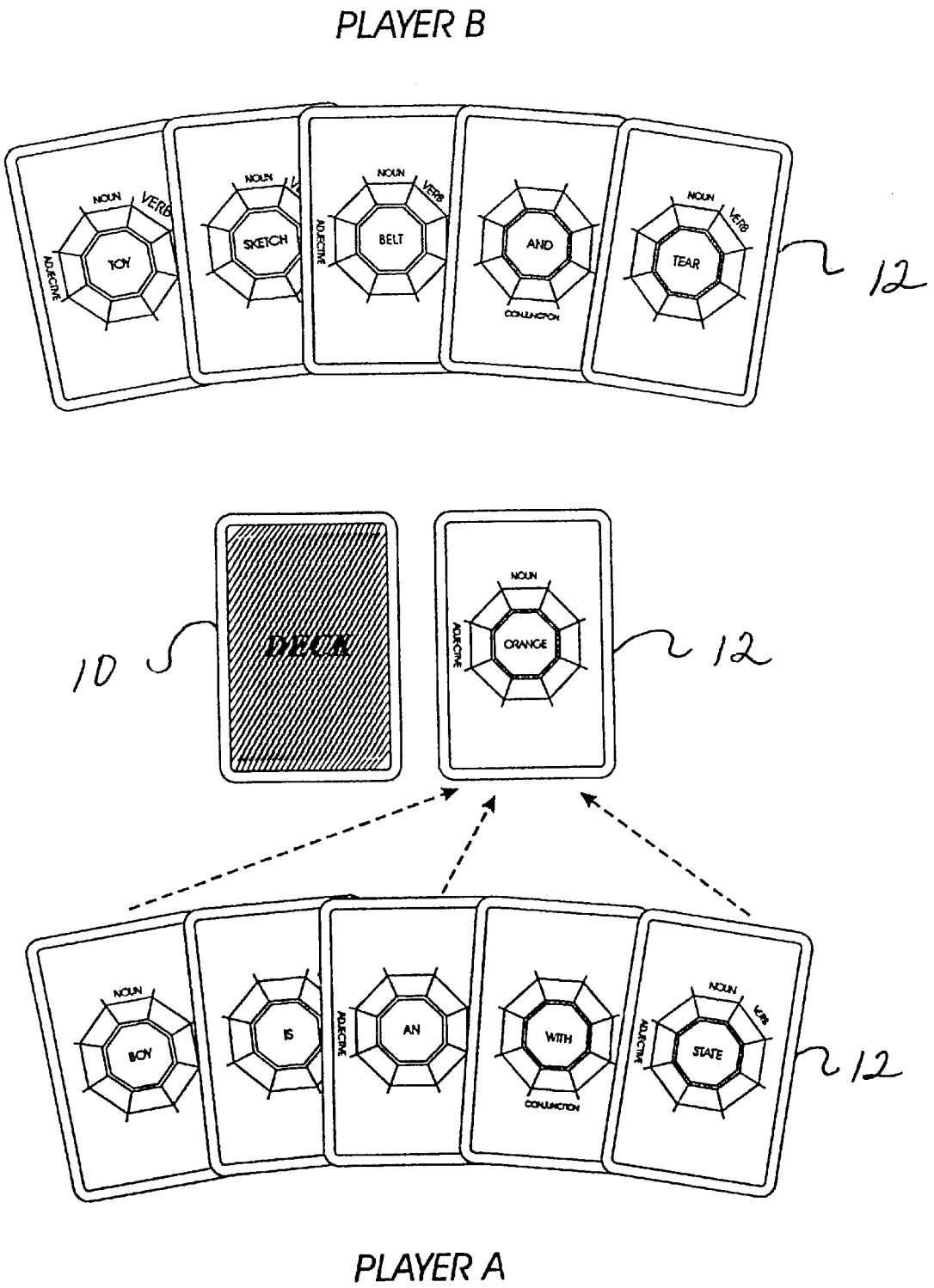
FIG. 1 is an environmental view depicting an educational language skills game being played according to the present invention.

As illustrated in FIG. 1, the present invention utilizes a single deck 10 consisting of three hundred sixty (360) playing cards. There are three designs for the playing cards used in the game. An octagon, having equally divided sectors, is inscribed on the face of the card in each of the three designs. Each sector represents one of the eight forms of speech. Each sector can be color coded relative to the form of speech that it may represent. For example, a verb may be represented by the color red, a noun by the color green etc.

Figure 2A:
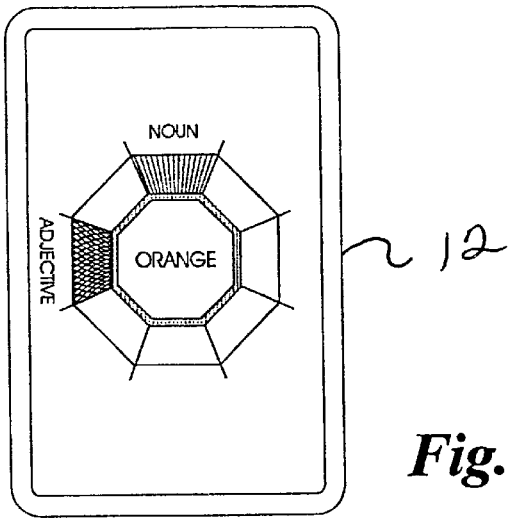
FIGS. 2A, 2B, and 2C are plan views of the three types of playing cards used in playing the card game according to the present invention.

In the preferred embodiment, as shown in FIG. 2A, the face of a card 12 is centrally inscribed (inside the octagon) with a word. A listing of all the forms of speech that the word may represent, depending upon its usage in a sentence or expression, is inscribed adjacent a designated, color-coded sector. Cards 12 are used when playing the first embodiment of the game (intended for use by individuals of age 7 to adult). Although the preferred embodiment as described herein is exemplary of forms of speech as used in the English language, the present invention can be readily adapted for teaching language skills in French, Spanish, German, Italian, and Latin using the principles taught herein.

Figure 2B:
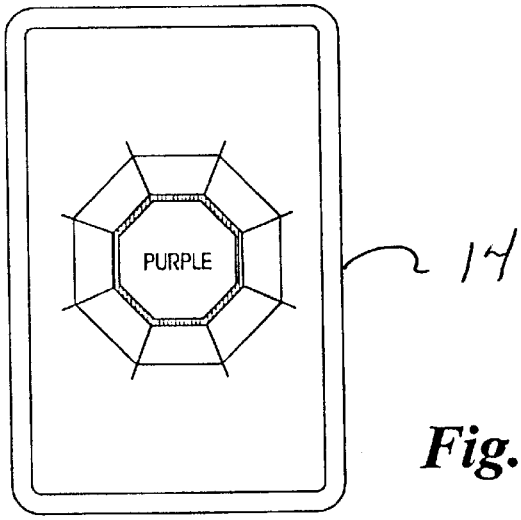

FIG. 2B shows a second card design at 14. Card 14 is centrally inscribed with a word but has no listing of the forms of speech that the word may represent. Cards 14 are used when playing the second embodiment of the game (preferably, from age 15 to adult).

Figure 2C:
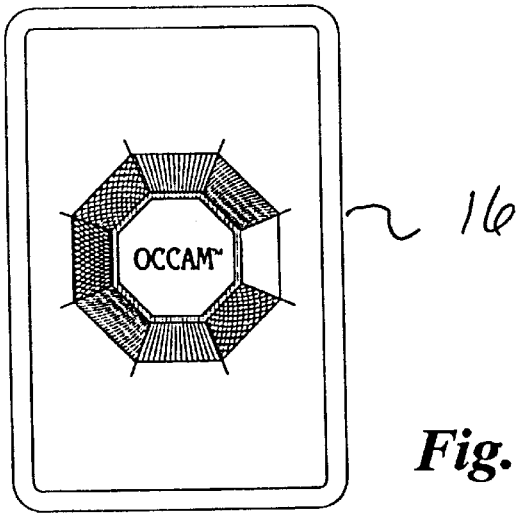

A third card design is illustrated in FIG. 2C at 16. Cards 16 are designated as wild cards and are inscribed with the word "OCCAM". Cards 16 are used in playing both embodiments of the game.

Three hundred fifty (350) cards in deck 10 will be of the card 12 design when playing the game of the first embodiment. Likewise, three hundred fifty (350) cards in deck 10 will be of the card 14 design when playing the game of the second embodiment. In both instances, each card will have a different word inscribed thereon. There are ten (10) cards in the deck that are designated as wild cards 16 (OCCAM) when playing either embodiment. Although a dictionary is required when playing the second embodiment, the above described deck of cards is all the game equipment necessary for participants to play.

To play a round of the game of the first embodiment, each participant is dealt five cards from the deck 10. These five cards are considered hand-held. Subsequently, the deck is placed facedown on the playing surface and another card from the deck is turned face-up beside the face-down deck, as illustrated in FIG. 1. Play can then begin by rotation, either clockwise or counterclockwise, among players.

A participant, chosen by lot, is designated to start the game and may do so by matching one of his or her hand-held cards with the card lying face-up. A match is made when any part of speech represented or shown by a hand-held card is matched to any part of speech represented or shown by the face-up card. It is emphasized that the matching does not apply to the word, but rather applies to matching any one part of speech that the word can represent. If a word shown by a card (either hand-held or face-up) can be used as more than one part of speech, that card can be played according to any one of the parts of speech shown or represented by the inscribed word, in order to create a match.

In FIG. 1, for example, "orange" can be used as a noun or an adjective. The participant (A) may choose to play the "boy" card (noun) on top of the "orange" card to match the noun. Or participant (A) may choose to play the "an" card (adjective) or the "state" card (noun or adjective). Note that there is no option to play the "is" card (verb) or the "with" card (preposition) since "orange" cannot be used as a verb or a preposition. After the first participant plays, the next participant in rotation attempts to match a hand-held card with the card now showing face-up beside the deck, namely the last played card. For example, if participant (A) plays the "an" card, participant (B) can match with the "toy" or "belt" card. A participant who has no match loses a turn and must draw a card from the deck.

Figure 3:
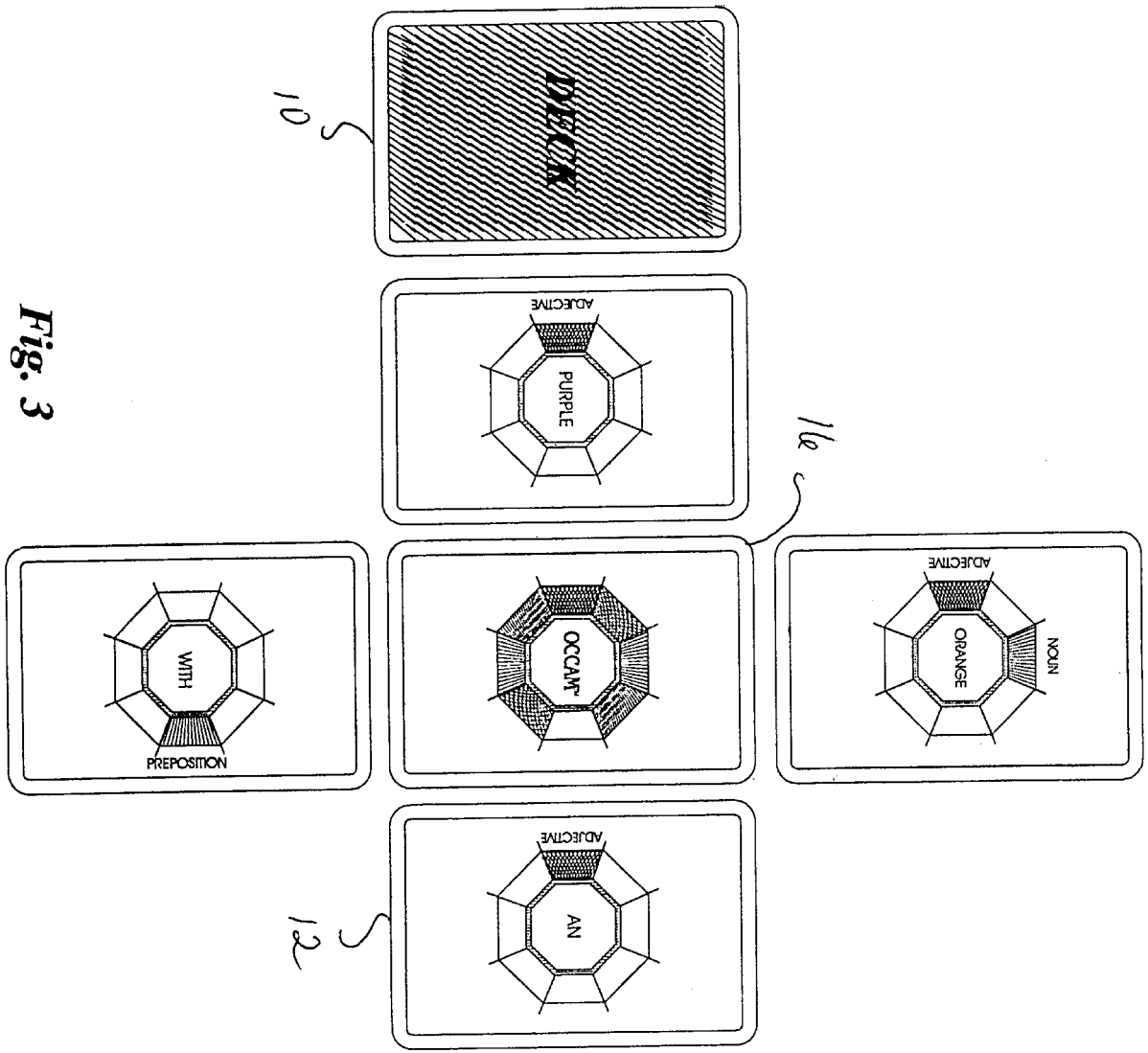
FIG. 3 is an environmental view depicting options which may be available to a playing participant according to the present invention.

Wild cards 16 are played in a special way. Wild cards when played, may be placed adjacent the card (orange) lying face-up as illustrated in FIG. 3. After a wild card has been played, the next three turns in rotation are allowed the opportunity to place any hand held card adjacent the wild card. If a wild card is turned up at the beginning of a round, the three-turn opportunity also applies. A wild card may also be played on top of an already played wild card. If this occurs, the three turn opportunity is nullified.

The first participant who gets rid of all the cards from his or her hand ends play of the round and wins the round. The winner of the round collects all the cards played plus all the cards remaining in each participant's hands. The collected cards from the round are put aside, no longer in play. A second round is started with the cards remaining in the deck. The second round is played exactly as the first round. If the deck is not used up, a third round is played, and so forth. If the deck is used up while a round is in progress, the participant with the least number of cards in hand wins the round.

Only after the deck is used up, or there are not enough cards to start an additional round, is the game over and a winner declared. The participant who has collected the greatest number of cards wins the game.

Participants may employ various strategies by playing wild cards on top of wild cards, or by refraining from playing certain cards in an attempt to require an opponent to draw additional cards from the deck. Strategy concepts are learned by a player as playing experience is gained.

Variations or additional rules to the basic play of the game as described above may be incorporated. For example, a Bonus or Superway to win a round is to form a complete sentence with the five cards dealt at the beginning of any round. Wild cards may be used as any word when forming the sentence. If the participant declaring the complete sentence actually does not have a complete sentence, he or she is out of the round and forfeits all cards already won to the eventual winner of that round. However, the player forming a correct sentence not only wins that round, but also garners all the cards each participant has already won through the previous rounds. If more than one player forms a complete sentence, they share equally all collected cards. If there is not an equal number of collected cards to be divided, cards are taken from the deck to make the win equitable for all players.

Except as described below, the game of the second embodiment is played exactly the same as that of the first embodiment, inclusive of variations as desired. When playing the second embodiment of the present invention, cards 14 are used in lieu of cards 12. Unlike cards 12, cards 14 do not include a listing of the forms of speech that an inscribed word can represent. Playing this version requires the use of a dictionary to assist in determining a word's form of speech during a challenge. A challenge occurs after a card has been played as a particular form of speech by the player of turn, which play may be challenged by any one of the other participants in rotation who thereby becomes a challenger.

If the dictionary shows that the word usage is incorrect, the participant playing the card must forfeit three collected cards to the challenger. If the word usage is correct, the challenger must forfeit three collected cards to the playing participant. A participant may owe cards to another participant. The owed cards are included in the total number of cards counted at the end of the game.

It is to be understood that the present invention is not limited to the embodiments described above, but encompasses any and all embodiments within the scope of the following claims.

I claim:

1. A method of playing a game comprising the steps of:

distributing to participants a predetermined number of cards from a deck, each card of the deck having a word inscribed thereon, the distributed cards thereby defining a set of hand-held cards;

placing the deck, less the distributed cards, face-down on a playing surface;

drawing a single card from the deck and placing the single card adjacent to the deck face-up on the playing surface;

allowing the participants in turn to perform an action relative to the word inscribed on the single card, said action comprising matching a characteristic of the word inscribed on the single card with a characteristic of a word inscribed on one of the participant's hand-held cards;

wherein the characteristic of the word is each part of speech for which the word can be used, and said matching step includes matching one of eight parts of speech.

2. The method as claimed in claim 1, wherein the predetermined number is five.

3. The method as claimed in claim 2, including the step of drawing a card from the deck into the hand-held cards if no match can be found.

4. The method as claimed in claim 1, wherein the characteristic of the word is inscribed on each card.

5. The method as claimed in claim 1, further including the step of challenging the matching step of another participant by disputing that the part of speech for which the word can be used in a sentence is correct.

6. The method as claimed in claim 5 further including the step of using a dictionary to determine whether the part of speech for which the word can be used in a sentence is correct.

7. The method as claimed in claim 1, further including the step of playing a wild card which matches any and all forms of speech represented by the word, by laying the wild card adjacent a previously played card.

8. The method as claimed in claim 7, further including the step of playing a wild card on top of a previously played wild card.

9. A word game comprising:

a first predetermined number of cards forming a portion of a deck, each card of said first predetermined number having inscribed thereon an object word and each part of speech for which said object word can be used in a sentence;

wherein said deck further includes a second predetermined number of cards forming a portion of said deck, each card of said second predetermined number having the word OCCAM inscribed thereon.

10. The word game according to claim 9, wherein said first predetermined number is three hundred fifty.

11. The word game according to claim 10, wherein said second predetermined number is ten.

12. A word game comprising:

a first predetermined number of cards forming a portion of a deck, each card of said first predetermined number having inscribed thereon an object word and each part of speech for which said object word can be used in a sentence;

wherein each card of said first predetermined number has inscribed thereon an octagon, said octagon has eight equally divided sectors, each sector corresponds to one of the parts of speech, and each sector has a corresponding color; and each card of said first predetermined number has the sector corresponding to each said part of speech for which said object word can be used marked with said corresponding color.

* * * * *